US010335628B1

(12) United States Patent
Scarpa

(10) Patent No.: US 10,335,628 B1
(45) Date of Patent: Jul. 2, 2019

(54) ROLLING DUMBELLS

(71) Applicant: Nazzaro Scarpa, Wakefield, MA (US)

(72) Inventor: Nazzaro Scarpa, Wakefield, MA (US)

( * ) Notice: Subject to any disclaimer, the term of this patent is extended or adjusted under 35 U.S.C. 154(b) by 96 days.

(21) Appl. No.: 15/669,196

(22) Filed: Aug. 4, 2017

Related U.S. Application Data

(63) Continuation-in-part of application No. 14/969,138, filed on Dec. 15, 2015, now abandoned.

(51) Int. Cl.
*A63B 21/00* (2006.01)
*A63B 21/06* (2006.01)
*A63B 23/12* (2006.01)
*A63B 21/072* (2006.01)

(52) U.S. Cl.
CPC .... *A63B 21/0618* (2013.01); *A63B 21/00061* (2013.01); *A63B 21/0726* (2013.01); *A63B 21/0728* (2013.01); *A63B 21/4035* (2015.10); *A63B 21/4043* (2015.10); *A63B 23/12* (2013.01)

(58) Field of Classification Search
CPC ..... A63B 21/0724; A63B 21/0726; A63B 21/0728; A63B 21/072–075; A63B 21/0004; A63B 22/20–205; A63B 23/1236
See application file for complete search history.

(56) References Cited

U.S. PATENT DOCUMENTS 2,676,802 A * 4/1954 O'Brien ..... A63B 21/0724 446/431
3,134,590 A 5/1964 Young
4,351,526 A * 9/1982 Schwartz ..... A63B 21/0726 482/105
D279,495 S 7/1985 Barbeau
5,171,199 A * 12/1992 Panagos ..... A63B 21/072 482/106
5,222,930 A * 6/1993 Bold, Jr. ..... A63B 21/227 482/108
7,011,610 B2 * 3/2006 Wawrzyniak ..... A63B 21/0726 482/104
8,118,717 B1 * 2/2012 Lai ..... A63B 21/0726 482/108
8,246,525 B2 8/2012 Chen
8,821,357 B2 9/2014 Reid
2004/0067826 A1 * 4/2004 Elledge ..... A63B 21/0601 482/106
2004/0180763 A1 * 9/2004 Wawrzyniak ..... A63B 21/0726 482/107
2006/0172871 A1 * 8/2006 Cao ..... A63B 21/075 482/106
2007/0243978 A1 * 10/2007 Allen, Jr. ..... A63B 23/0211 482/108
2008/0070762 A1 * 3/2008 White ..... A63B 21/0004 482/108

* cited by examiner

*Primary Examiner* — Nyca T Nguyen

(57) ABSTRACT

The rolling dumbbells is a continuation in part of USPTO non-provisional application U.S. Ser. No. 14/969,138. The present disclosure presents an alternate attachment mechanism for attaching the first wheel and the second wheel of the cited disclosure to the grip of the cited disclosure. The rolling dumbbells comprises a threaded rod, a first nut, and a second nut. The grip of the cited disclosure is modified to further comprise a third axial aperture. The threaded rod forms a threaded connection with the first nut, a first threaded center, the third axial aperture of the grip, a second threaded center, and the second nut to attach the first wheel and the second wheel to the grip.

13 Claims, 3 Drawing Sheets

ROLLING DUMBELLS

CROSS REFERENCES TO RELATED APPLICATIONS

This non-provisional application is a continuation in part application filed under 37 CFR 1.53(b). The present application claims priority under 35 USC 120 to U.S. non-provisional application Ser. No. 14/969,138 filed on Dec. 15, 2015 by the inventor Nazzaro Scarpa.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of exercise apparatus for use in developing and strengthening muscles, more specifically, user manipulated weights.

SUMMARY OF INVENTION

The present disclosure claims priority under 35 USC 120 to United States non-provisional application U.S. Ser. No. 14/969,138 filed on Dec. 15, 2015 by the inventor Nazzaro Scarpa. Specifically, non-provisional application U.S. Ser. No. 14/969,138 (hereinafter cited disclosure) discloses a rolling dumbbell having detachable wheel weight elements. The cited disclosure further discloses a handle, a first wheel 105 and a second wheel 106. The first wheel 105 and the second wheel 106 attach to the handle such that: 1) the first wheel 105 and the second wheel 106 rotate freely around a center of rotation aligned with the center axis of the handle; and, 2) the first wheel 105 and the second wheel 106 are detachably attached to the handle such that the first wheel 105 and the second wheel 106 can be exchanged with additional wheels for the purpose of adjusting the training weight provided by the disclosed rolling dumbbell.

Within the cited disclosure: 1) the first wheel 105 comprises a first weighted wheel 311, a first ball bearing 312, and a first threaded center 313; and, 2) the second wheel 106 comprises a second weighted wheel 321, a second ball bearing 322, and a second threaded center 323. Within context of the present disclosure, the first wheel 105 and the second wheel 106 are identical in construction to the first wheel 105 and the second wheel 106 of the cited disclosure. For purposes of clarity of clarity within the present disclosure: 1) the first threaded center 313 will be further defined with a first interior screw thread 314, a first center axis 315, and a first inner diameter 316; and, 2) the second threaded center 323 will be further defined with a second interior screw thread 324, a second center axis 325, and a second inner diameter 326. Within the cited disclosure, the handle comprises a grip 120. The grip 120 is further defined with a first end 161 and a second end 162. Within context of the present disclosure, the grip 120 maintains an exterior form factor that is identical to the grip 120 of the cited disclosure but is otherwise modified to accommodate the present disclosure.

The present disclosure presents an alternative method for attaching the first wheel 105 and the second wheel 106 to the handle.

These together with additional objects, features and advantages of the rolling dumbbells will be readily apparent to those of ordinary skill in the art upon reading the following detailed description of the presently preferred, but nonetheless illustrative, embodiments when taken in conjunction with the accompanying drawings.

In this respect, before explaining the current embodiments of the rolling dumbbells in detail, it is to be understood that the rolling dumbbells is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rolling dumbbells.

It is therefore important that the claims be regarded as including such equivalent construction insofar as they do not depart from the spirit and scope of the rolling dumbbells. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
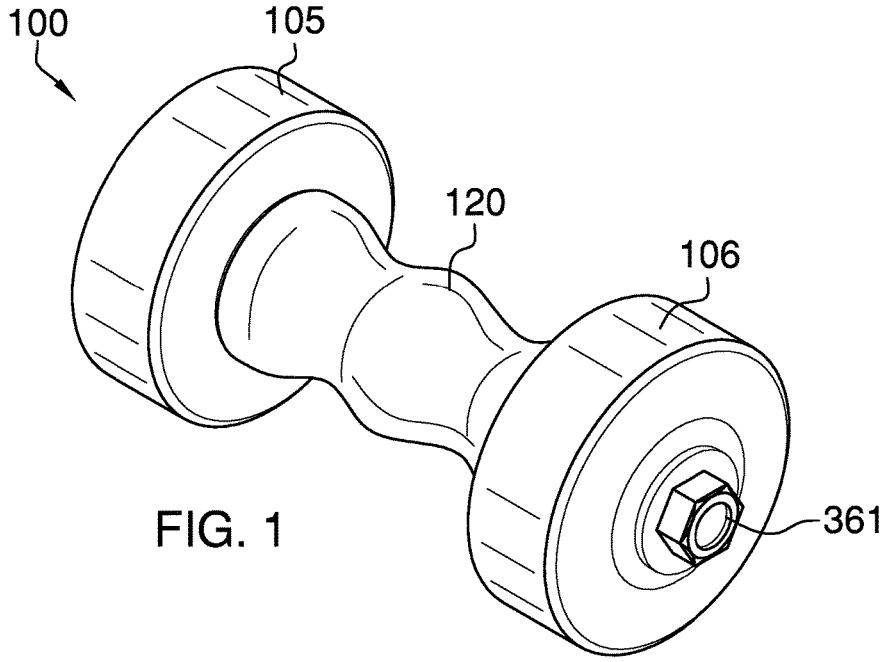
FIG. 1 is a perspective view of an embodiment of the disclosure.
Figure 2:
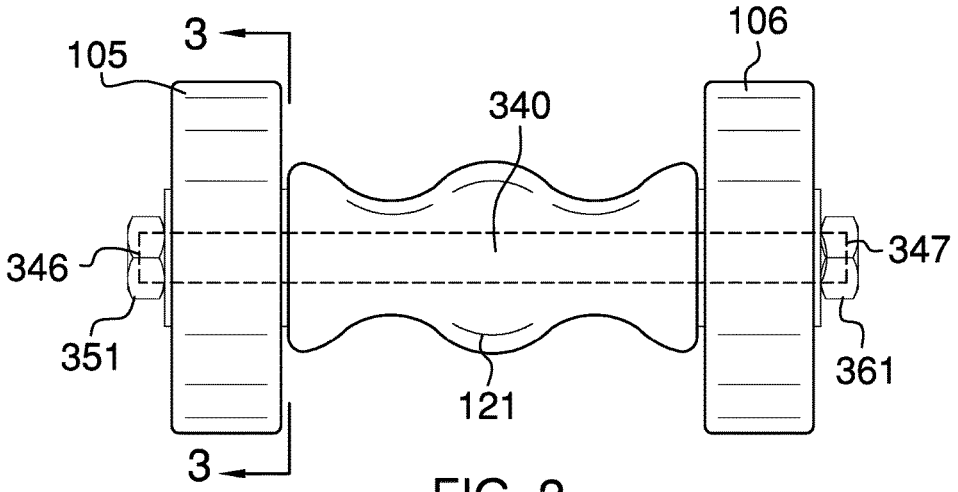
FIG. 2 is a front view of an embodiment of the disclosure.
Figure 3:
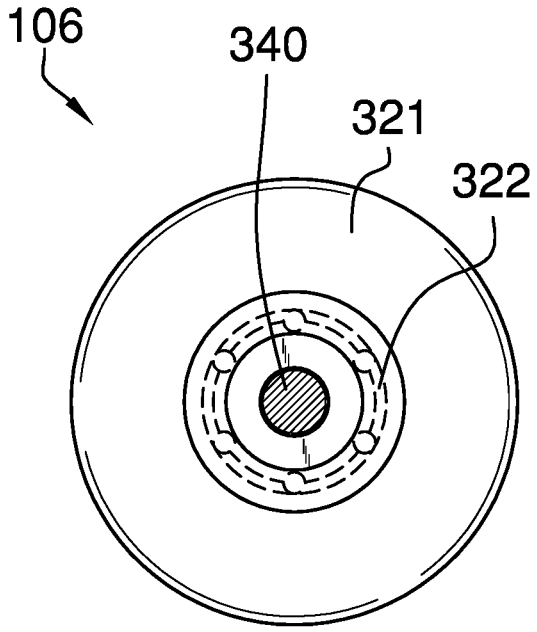
FIG. 3 is a cross-sectional view of an embodiment of the disclosure across 3-3 as shown in FIG. 2.
Figure 4:
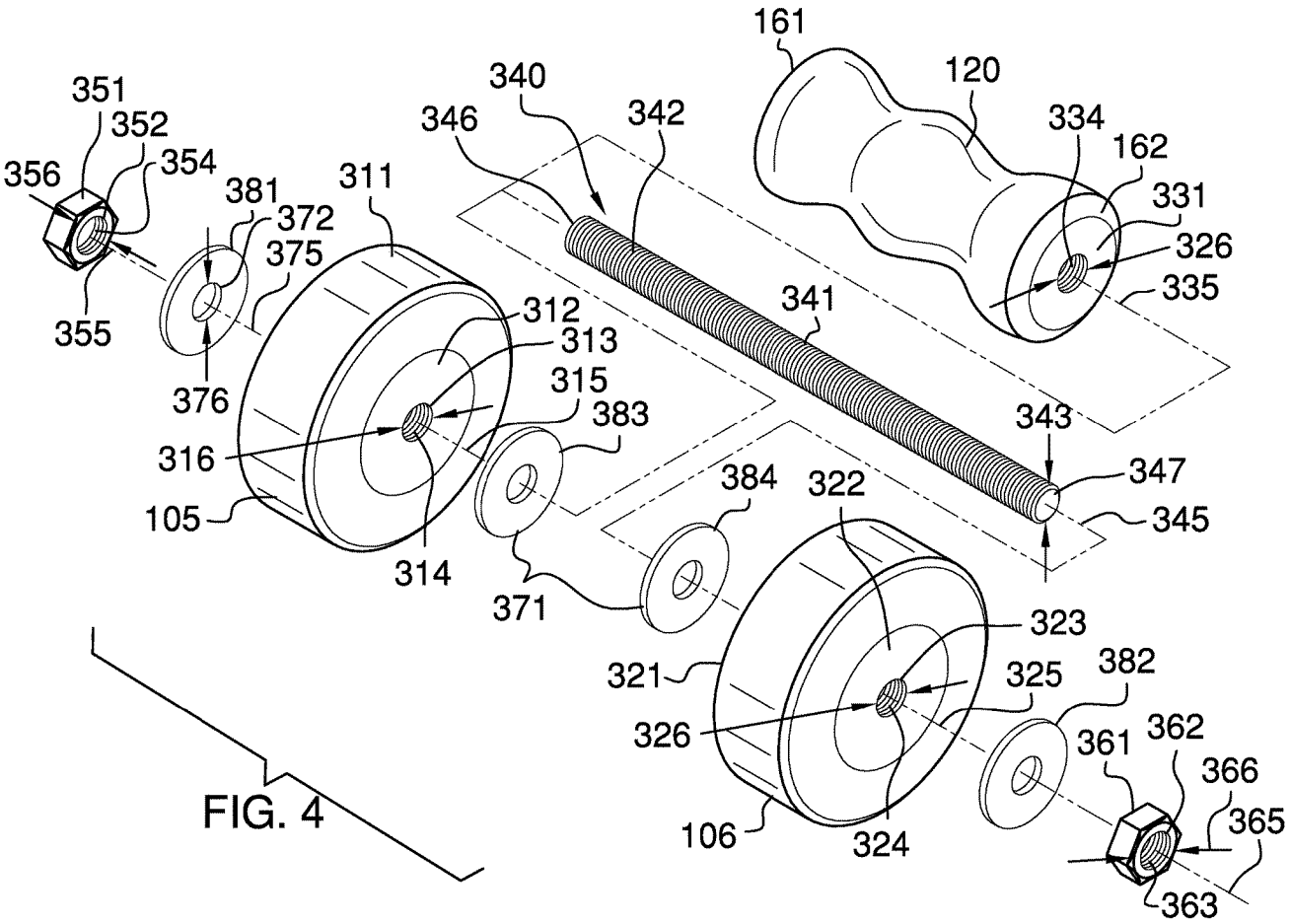
FIG. 4 is an exploded view of an embodiment of the disclosure.

Detailed reference will now be made to one or more potential embodiments of the disclosure, which are illustrated in FIGS. 1 through 4.

The rolling dumbbells 100 (hereinafter invention) is an extension and an alternate attachment mechanism for attaching the first wheel 105 and the second wheel 106 of the cited disclosure to the grip 120 of the cited disclosure. The invention 100 comprises a threaded rod 340, a first nut 351, and a second nut 361. The grip 120 of the cited disclosure is modified to further comprise a third axial aperture 331. The threaded rod 340 forms a threaded connection with the first nut 351, the first threaded center 313, the third axial aperture 331 of the grip 120, the second threaded center 323, and the second nut 361 to attach the first wheel 105 and the second wheel 106 to the grip 120.

The first weighted wheel 311 is a disk shaped structure that forms the weighted wheel of the first wheel 105 as described in the cited disclosure. The first ball bearing 312 is a commercially available disk shaped ball bearing that is coaxially installed in the first weighted wheel 311 such that the center axes of the first ball bearing 312 and the first weighted wheel 311 are aligned. The installation of the first ball bearing 312 in the first weighted wheel 311 is more fully described in the cited disclosure. The center axis of the first ball bearing 312 forms the center of rotation of the first weighted wheel 311.

The first threaded center 313 is a cylindrically shaped negative space that is formed in a coaxial manner through the first ball bearing 312. The threaded rod 340 is installed in the first threaded center 313.

The first interior screw thread 314 is an interior screw thread that is formed on the interior surface of the first threaded center 313. The first interior screw thread 314 is sized to match the first exterior screw thread 342 of the threaded rod 340 such that the threaded rod 340 can be screwed through the first interior screw thread 314 to form a threaded connection.

The first center axis 315 is the center axis of the first threaded center 313. The first center axis 315 is aligned with the center axis of the first ball bearing 312. The first inner diameter 316 refers to the inner diameter of the first threaded center 313.

The span of the first inner diameter 316 of the first threaded center 313 is greater than the span of the first outer diameter 343 of the threaded rod 340 such that the threaded rod 340 can be inserted into the first threaded center 313.

The second weighted wheel 321 is a disk shaped structure that forms the weighted wheel of the second wheel 106 as described in the cited disclosure. The second ball bearing 322 is a commercially available disk shaped ball bearing that is coaxially installed in the second weighted wheel 321 such that the center axes of the second ball bearing 322 and the second weighted wheel 321 are aligned. The installation of the second ball bearing 322 in the second weighted wheel 321 is more fully described in the cited disclosure. The center axis of the second ball bearing 322 forms the center of rotation of the second weighted wheel 321.

The second threaded center 323 is a cylindrically shaped negative space that is formed in a coaxial manner through the second ball bearing 322. The threaded rod 340 is installed in the second threaded center 323.

The second interior screw thread 324 is an interior screw thread that is formed on the interior surface of the second threaded center 323. The second interior screw thread 324 is sized to match the first exterior screw thread 342 of the threaded rod 340 such that the threaded rod 340 can be screwed through the second interior screw thread 324 to form a threaded connection.

The second center axis 325 is the center axis of the second threaded center 323. The second center axis 325 is aligned with the center axis of the second ball bearing 322. The second inner diameter 326 refers to the inner diameter of the second threaded center 323.

The span of the second inner diameter 326 of the second threaded center 323 is greater than the span of the first outer diameter 343 of the threaded rod 340 such that the threaded rod 340 can be inserted into the second threaded center 323.

The grip 120 is a roughly cylindrical object that is used as the handhold for the invention 100. Within the present disclosure, it is assumed that the grip 120 is identical to the grip 120 described in the cited disclosure. The grip 120 is further defined with a first end 161 and a second end 162. The first end 161 is identical to the first end 161 as described in the cited disclosure. The second end 162 is identical to the second end 162 as described in the cited disclosure. The grip 120 further comprises a third axial aperture 331. The third axial aperture 331 comprises a third interior screw thread 334, a third center axis 335, and a third inner diameter 336.

The third axial aperture 331 is a cylindrically shaped negative space that is formed in a coaxial manner through the grip 120 from the first end 161 to the second end 162. The third center axis 335 of the third axial aperture 331 is aligned with the center axis of the grip 120.

The third interior screw thread 334 is an interior screw thread that is formed on the interior surface of the third axial aperture 331. The third interior screw thread 334 is sized to match the first exterior screw thread 342 of the threaded rod 340 such that the threaded rod 340 can be screwed through the third interior screw thread 334 to form a threaded connection.

The third center axis 335 is the center axis of the third axial aperture 331. The third inner diameter 336 refers to the inner diameter of the third axial aperture 331. The span of the third inner diameter 336 of the first exterior screw thread 342 is greater than the span of the first outer diameter 343 of the threaded rod 340 such that the threaded rod 340 can be inserted into the third axial aperture 331.

The threaded rod 340 is a cylindrical structure upon which the first wheel 105, the second wheel 106, and the grip 120 are attached. The threaded rod 340 comprises a cylindrical shaft 341, a first exterior screw thread 342, a first outer diameter 343, and a seventh center axis 345. The cylindrical shaft 341 is a commercially available cylindrical rod. The first exterior screw thread 342 is an exterior screw thread that is formed on the exterior face of the cylindrical shaft 341. The first outer diameter 343 refers to the outer diameter of the cylindrical shaft 341. The seventh center axis 345 refers to the center axis of the cylindrical shaft 341.

The first nut 351 is a readily and commercially available disk shaped hardware item. The first nut 351 comprises a first axial aperture 352. The first axial aperture 352 comprises a fourth interior screw thread 354, a fourth center axis 355, and a fourth inner diameter 356.

The first axial aperture 352 is a cylindrical negative space that is formed coaxially through the disk shape of the first nut 351. The fourth interior screw thread 354 is an interior screw thread that is formed on the interior surface of the first axial aperture 352. The fourth interior screw thread 354 is sized to receive the first exterior screw thread 342 of the threaded rod 340 to form a threaded connection.

The fourth center axis 355 refers to the center axis of the first axial aperture 352. The fourth center axis 355 is aligned with the center axis of the disk formed by the first nut 351. The fourth inner diameter 356 refers to the inner diameter of the first axial aperture 352. The fourth inner diameter 356 is sized such that the threaded rod 340 can be inserted into the first axial aperture 352.

The second nut 361 is a readily and commercially available disk shaped hardware item. The second nut 361 comprises a second axial aperture 362. The second axial aperture 362 comprises a fifth interior screw thread 364, a fifth center axis 365, and a fifth inner diameter 366.

The second axial aperture 362 is a cylindrical negative space that is formed coaxially through the disk shape of the second nut 361. The fifth interior screw thread 364 is an interior screw thread that is formed on the interior surface of the second axial aperture 362. The fifth interior screw thread 364 is sized to receive the first exterior screw thread 342 of the threaded rod 340 to form a threaded connection.

The fifth center axis 365 refers to the center axis of the second axial aperture 362. The fifth center axis 365 is aligned with the center axis of the disk formed by the second nut 361. The fifth inner diameter 366 refers to the inner diameter of the second axial aperture 362. The fifth inner diameter 366 is sized such that the threaded rod 340 can be inserted into the second axial aperture 362.

Each of the plurality of washers 371 is a readily and commercially available disk shaped hardware item that is used to increase the surface area that bears the load generated by a threaded connection. Each of the plurality of washers 371 comprises a fourth axial aperture 372. The fourth axial aperture 372 comprises a sixth center axis 375 and a sixth inner diameter 376. The fourth axial aperture 372 is a cylindrical negative space that is formed coaxially through the disk shape of the plurality of washers 371. The sixth center axis 375 refers to the center axis of the fourth axial aperture 372. The sixth inner diameter 376 refers to the inner diameter of the fourth axial aperture 372.

The plurality of washers 371 comprises a first washer 381, a second washer 382, a third washer 383, and a fourth washer 384. The first washer 381 is a commercially available washer that is sized such that the threaded rod 340 can be inserted through the first washer 381. The second washer 382 is a commercially available washer that is sized such that the threaded rod 340 can be inserted through the second washer 382. The third washer 383 is a commercially available washer that is sized such that the threaded rod 340 can be inserted through the third washer 383. The fourth washer 384 is a commercially available washer that is sized such that the threaded rod 340 can be inserted through the fourth washer 384.

The invention 100 is assembled as described in the following 3 paragraphs.

The threaded rod 340 screws through the third axial aperture 331 of the grip 120 such that the fourth end 347 of the threaded rod 340 extends beyond the second end 162 of the grip 120 and the third end 346 of the threaded rod 340 extends beyond the first end 161 of the grip 120. The third washer 383 slides over the third end 346 of the threaded rod 340 such that the third washer 383 presses against the first end 161 of the grip 120. The fourth washer 384 slides over the fourth end 347 of the threaded rod 340 such that the fourth washer 384 presses against the second end 162 of the grip 120.

The first threaded center 313 of the first ball bearing 312 screws onto the third end 346 of the threaded rod 340 such that: 1) the first wheel 105 presses against the third washer 383; and, 2) the third end 346 of the threaded rod 340 extends beyond the first ball bearing 312. The second threaded center 323 of the second ball bearing 322 screws onto the fourth end 347 of the threaded rod 340 such that: 1) the second wheel 106 presses against the fourth washer 384; and, 2) the fourth end 347 of the threaded rod 340 extends beyond the second ball bearing 322.

The first washer 381 slides over the third end 346 of the threaded rod 340 such that the first washer 381 presses against the first ball bearing 312 of the first wheel 105. The second washer 382 slides over the fourth end 347 of the threaded rod 340 such that the second washer 382 presses against the second ball bearing 322 of the second wheel 106. The first nut 351 screws onto the third end 346 of the threaded rod 340 such that the first nut 351 presses against the first washer 381. The second nut 361 screws onto the fourth end 347 of the threaded rod 340 such that the second nut 361 presses against the second washer 382.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Coaxial: As used in this disclosure, coaxial is an term that refers to a first object that is inserted or contained within a second object such: 1) that the first object and the second object share the same center point if the or first object and the second object are treated as a two dimensional objects; or, 2) that the first object and the second object share the same center axis if the or first object and the second object are treated as a prism.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder, which is defined as a cylinder wherein the curved surface perpendicularly intersects with the two identical flat and parallel ends.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs.

Disk: As used in this disclosure, a disk is a cylindrically shaped object that is flat in appearance.

Exterior Screw Thread: An exterior screw thread is a ridge wrapped around the outer surface of a tube in the form of a helical structure that is used to convert rotational movement into linear movement.

Form Factor: As used in this disclosure, the term form factor refers to the size and shape of an object.

Inner Diameter: As used in this disclosure, the term inner diameter is used in the same way that a plumber would refer to the inner diameter of a pipe.

Interior Screw Thread: An interior screw thread is a groove that is formed around the inner surface of a tube in the form of a helical structure that is used to convert rotational movement into linear movement.

Negative Space: As used in this disclosure, negative space is a method of defining an object through the use of open or empty space as the definition of the object itself, or, through the use of open or empty space to describe the boundaries of an object.

Nut: As used in this disclosure, a nut is a first object that is formed with a cylindrical negative space that further comprises an interior screw thread such that a second object with a matching exterior screw thread can screwed into the first object forming a threaded connection. A nut is further defined with an inner diameter.

Outer Diameter: As used in this disclosure, the term outer diameter is used in the same way that a plumber would refer to the outer diameter of a pipe.

Radial: As used in this disclosure, the term radial refers to a direction that: 1) is perpendicular to an identified central axis; or, 2) projects away from a center point.

Ring: As used in this disclosure, a ring is term that is used to describe a flat or plate like structure through which an aperture is formed.

Screw: When used as a verb in this disclosure, to screw means: 1) to fasten or unfasten (unscrew) a threaded connection; or 2) to attach a helical structure to a solid structure.

Threaded Connection: As used in this disclosure, a threaded connection is a type of fastener that is used to join a first tube shaped and a second tube shaped object together. The first tube shaped object is fitted with fitted with a first fitting selected from an interior screw thread or an exterior screw thread. The second tube shaped object is fitted with the remaining screw thread. The tube shaped object fitted with the exterior screw thread is placed into the remaining tube shaped object such that: 1) the interior screw thread and the exterior screw thread interconnect; and, 2) when the tube shaped object fitted with the exterior screw thread is rotated the rotational motion is converted into linear motion that moves the tube shaped object fitted with the exterior screw thread either into or out of the remaining tube shaped object. The direction of linear motion is determined by the direction of rotation.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An exercise device comprising:

a threaded rod, a first nut, and a second nut;

wherein the threaded rod, the first nut, and the second nut attaches a first wheel and a second wheel to a grip;

wherein the first wheel comprises a first weighted wheel, a first ball bearing, and a first threaded center;

wherein the second wheel comprises a second weighted wheel, a second ball bearing, and a second threaded center;

wherein the first threaded center is further defined with a first interior screw thread, a first center axis, and a first inner diameter;

wherein the second threaded center is further defined with a second interior screw thread, a second center axis, and a second inner diameter;

wherein the grip is further defined with a first end and a second end;

wherein the first wheel and the second wheel are identical;

wherein the first weighted wheel is a disk shaped structure;

wherein the first ball bearing is coaxially installed in the first weighted wheel such that the center axes of the first ball bearing and the first weighted wheel are aligned;

wherein the first threaded center is a cylindrically shaped negative space that is formed in a coaxial manner through the first ball bearing;

wherein the first interior screw thread is an interior screw thread that is formed on the interior surface of the first threaded center;

wherein the second weighted wheel is a disk shaped structure;

wherein the second ball bearing is coaxially installed in the second weighted wheel such that the center axes of the second ball bearing and the second weighted wheel are aligned;

wherein the second threaded center is a cylindrically shaped negative space that is formed in a coaxial manner through the second ball bearing;

wherein the second interior screw thread is an interior screw thread that is formed on the interior surface of the second threaded center;

wherein the threaded rod forms a plurality of threaded connections with the first nut, the first threaded center, the third axial aperture of the grip, the second threaded center, and the second nut;

wherein the threaded rod is a cylindrical structure upon which the first wheel, the second wheel, and the grip are attached;

wherein the threaded rod comprises a cylindrical shaft, a first exterior screw thread, a first outer diameter, and a seventh center axis;

wherein the cylindrical shaft is a rod;

wherein the first exterior screw thread is an exterior screw thread that is formed on the exterior face of the cylindrical shaft;

wherein the first outer diameter refers to the outer diameter of the cylindrical shaft;

wherein the seventh center axis refers to the center axis of the cylindrical shaft;

wherein the span of the first inner diameter of the first threaded center is greater than the span of the first outer diameter of the threaded rod such that the threaded rod is inserted into the first threaded center;

wherein the span of the second inner diameter of the second threaded center is greater than the span of the first outer diameter of the threaded rod such that the threaded rod is inserted into the second threaded center;

wherein the first interior screw thread is sized to match the first exterior screw thread of the threaded rod such that the threaded rod is screwed through the first interior screw thread;

wherein the second interior screw thread is sized to match the first exterior screw thread of the threaded rod such that the threaded rod is screwed through the second interior screw thread;

wherein the grip is a cylindrical object;

wherein the grip further comprises a third axial aperture;

wherein the third axial aperture is a cylindrically shaped negative space that is formed in a coaxial manner through the grip from the first end to the second end;

wherein the third axial aperture comprises a third interior screw thread, a third center axis, and a third inner diameter;

wherein the third center axis of the third axial aperture is aligned with the center axis of the grip;

wherein the third interior screw thread is an interior screw thread that is formed on the interior surface of the third axial aperture;

wherein the third center axis is the center axis of the third axial aperture.

2. The exercise device according to claim 1 wherein the span of the third inner diameter of the first exterior screw thread is greater than the span of the first outer diameter of the threaded rod such that the threaded rod is inserted into the third axial aperture.

3. The exercise device according to claim 2 wherein the third interior screw thread is sized to match the first exterior screw thread of the threaded rod such that the threaded rod is screwed through the third interior screw thread to form a threaded connection.

4. The exercise device according to claim 3 wherein the first nut is a hardware item;

wherein the first nut comprises a first axial aperture;

wherein the first axial aperture comprises a fourth interior screw thread, a fourth center axis, and a fourth inner diameter;

wherein the first axial aperture is a cylindrical negative space that is formed coaxially through the disk shape of the first nut;

wherein the fourth interior screw thread is an interior screw thread that is formed on the interior surface of the first axial aperture;

wherein the fourth center axis refers to the center axis of the first axial aperture;

wherein the fourth center axis is aligned with the center axis of the disk formed by the first nut;

wherein the fourth inner diameter refers to the inner diameter of the first axial aperture.

5. The exercise device according to claim 4 wherein the second nut is a hardware item;

wherein the second nut comprises a second axial aperture;

wherein the second axial aperture comprises a fifth interior screw thread, a fifth center axis, and a fifth inner diameter;

wherein the second axial aperture is a cylindrical negative space that is formed coaxially through the disk shape of the second nut;

wherein the fifth interior screw thread is an interior screw thread that is formed on the interior surface of the second axial aperture;

wherein the fifth center axis refers to the center axis of the second axial aperture;

wherein the fifth center axis is aligned with the center axis of the disk formed by the second nut;

wherein the fifth inner diameter refers to the inner diameter of the second axial aperture.

6. The exercise device according to claim 5 wherein the fourth interior screw thread is sized to receive the first exterior screw thread of the threaded rod to form a threaded connection;

wherein the fourth inner diameter is sized such that the threaded rod is inserted into the first axial aperture;

wherein the fifth interior screw thread is sized to receive the first exterior screw thread of the threaded rod to form a threaded connection;

wherein the fifth inner diameter is sized such that the threaded rod is inserted into the second axial aperture.

7. The exercise device according to claim 6 further comprising a plurality of washers;

wherein each of the plurality of washers is a disk;

wherein each of the plurality of washers comprises a fourth axial aperture;

wherein the fourth axial aperture comprises a sixth center axis and a sixth inner diameter;

wherein the fourth axial aperture is a cylindrical negative space that is formed coaxially through the disk shape of the plurality of washers;

wherein the sixth center axis refers to the center axis of the fourth axial aperture;

wherein the sixth inner diameter refers to the inner diameter of the fourth axial aperture.

8. The exercise device according to claim 7 wherein the plurality of washers comprises a first washer, a second washer, a third washer, and a fourth washer;

wherein the first washer is sized such that the threaded rod is inserted through the first washer;

wherein the second washer is sized such that the threaded rod is inserted through the second washer;

wherein the third washer is sized such that the threaded rod is inserted through the third washer;

wherein the fourth washer is sized such that the threaded rod is inserted through the fourth washer.

9. The exercise device according to claim 8 wherein the threaded rod screws through the third axial aperture of the grip such that a second end of the threaded rod extends beyond the second end of the grip and a first end of the threaded rod extends beyond the first end of the grip.

10. The exercise device according to claim 9 wherein the third washer slides over the third end of the threaded rod such that the third washer presses against the first end of the grip;

wherein the first threaded center of the first ball bearing screws onto the third end of the threaded rod such that the first wheel presses against the third washer;

wherein the first threaded center of the first ball bearing screws onto the third end of the threaded rod such that the third end of the threaded rod extends beyond the first ball bearing.

11. The exercise device according to claim 10 wherein the fourth washer slides over the fourth end of the threaded rod such that the fourth washer presses against the second end of the grip;

wherein the second threaded center of the second ball bearing screws onto the fourth end of the threaded rod such that the second wheel presses against the fourth washer;

wherein the second threaded center of the second ball bearing screws onto the fourth end of the threaded rod such that the fourth end of the threaded rod extends beyond the second ball bearing.

12. The exercise device according to claim 11 wherein the first washer slides over the third end of the threaded rod such that the first washer presses against the first ball bearing of the first wheel;

wherein the first nut screws onto the third end of the threaded rod such that the first nut presses against the first washer.

13. The exercise device according to claim 12 wherein the second washer slides over the fourth end of the threaded rod such that the second washer presses against the second ball bearing of the second wheel;

wherein the second nut screws onto the fourth end of the threaded rod such that the second nut presses against the second washer.

* * * * *